US009102148B2

(12) United States Patent
Nystrom et al.

(10) Patent No.: US 9,102,148 B2
(45) Date of Patent: Aug. 11, 2015

(54) ELECTROSTATIC MEMBRANE DIFFUSION BONDING STRUCTURE AND PROCESS

(71) Applicant: XEROX CORPORATION, Norwalk, CT (US)

(72) Inventors: Peter J. Nystrom, Webster, NY (US); David L. Knierim, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 7 days.

(21) Appl. No.: 14/106,020

(22) Filed: Dec. 13, 2013

(65) Prior Publication Data

US 2015/0165769 A1 Jun. 18, 2015

(51) Int. Cl.
*B41J 2/04* (2006.01)
*B41J 2/14* (2006.01)
*B41J 2/16* (2006.01)

(52) U.S. Cl.
CPC ..... *B41J 2/14314* (2013.01); *B41J 2/1626* (2013.01)

(58) Field of Classification Search
USPC ..... 347/54, 112, 141
See application file for complete search history.

(56) References Cited

PUBLICATIONS

Knierim, "Glass Substrate Electrostatic Solid Ink Jet Head", U.S. Appl. No. 13/853,654, filed Mar. 29, 2013.
Nystrom, "Diaphragm for an Electrostatic Actuator in an Ink Jet Printer", U.S. Appl. No. 13/567,514, filed Aug. 6, 2012.

*Primary Examiner* — Stephen Meier
*Assistant Examiner* — Alexander D Shenderov
(74) *Attorney, Agent, or Firm* — MH2 Technology Law Group LLP

(57) ABSTRACT

A method and structure for a printhead including a plurality of electrostatic actuators may include the formation of a first conductive layer, a first dielectric layer over the first conductive layer, and a second dielectric layer over the first dielectric layer. The first and second dielectric layers may be patterned to expose the first conductive layer, then sidewalls of the first dielectric layer may be isotropically etched to recess the sidewalls under the second dielectric layer. A self-patterned second conductive layer may be formed to include a first portion that forms at least a portion of an actuator electrode and physically and electrically contacts the first conductive layer, and a second portion that physically contacts the second dielectric layer. An actuator membrane may be diffusion bonded to the second dielectric layer using the second portion of the second conductive layer.

14 Claims, 5 Drawing Sheets

ELECTROSTATIC MEMBRANE DIFFUSION BONDING STRUCTURE AND PROCESS

TECHNICAL FIELD

The present teachings relate to the field of ink jet printing devices and, more particularly, to methods and structures for electrostatically actuated ink jet printheads and a printer including an electrostatically actuated ink jet printhead.

BACKGROUND

Drop on demand ink jet technology is widely used in the printing industry. Printers using drop on demand ink jet technology may use a plurality of electrostatic actuators, piezoelectric actuators, or thermal actuators to eject ink from a plurality of nozzles in an aperture plate. In electrostatic ejection, each electrostatic actuator, which is formed on a substrate assembly, typically includes a flexible diaphragm or membrane, an ink chamber between the aperture plate and the membrane, and an air chamber between the actuator membrane and the substrate assembly. An electrostatic actuator further includes an actuator electrode formed on the substrate assembly. When a voltage is applied to activate the actuator electrode, the membrane is drawn toward the electrode by an electric field and actuates from a relaxed state to a flexed state, which increases a volume of the ink chamber and draws ink into the ink chamber from an ink supply or reservoir. When the voltage is removed to deactivate the actuator electrode, the membrane relaxes, the volume within the ink chamber decreases, and ink is ejected from the nozzle in the aperture plate.

One critical aspect of electrostatic actuators is the dimensions of a spacing or gap between the actuator electrode and the membrane. The gap affects both the volume of ink ejected from a nozzle upon removal of the voltage from the actuator electrode and the voltage that must be applied to the actuator electrode to sufficiently deflect the membrane. A gap that is too narrow or too wide will eject either an insufficient or excessive quantity of ink respectively. Further, as the gap height increases, the power that must be applied to the actuator electrode to sufficiently deflect the membrane also increases.

An electrostatic actuator further includes a dielectric gap standoff layer formed on portions of the conductive layer that is used to form the actuator electrodes. The membrane is adhered or bonded to an upper surface of the gap standoff to space the membrane from the electrode, and thus a thickness of the gap standoff layer partially determines the gap between the actuator electrode and the membrane. The gap height is also affected by the technique used to bond the membrane to the gap standoff. An adhesive layer, for example EPON™ available from Miller-Stephenson Chemical Co. of Danbury, Conn. or TechFilm i2300 available from Resin Designs, LLC of Woburn, Mass. may be interposed between the actuator electrode and the membrane, and then cured during the application of heat and pressure to bond the actuator membrane to the gap standoff. This process, however, is prone to contamination of the actuator air chamber with stray adhesive. Further, processing variation may affect the accuracy of the final adhesive thickness and contributes to variation in the gap height away from a target height. Other processes may be successful with only a limited range of materials and thus place restrictions on material selection.

A method for forming an electrostatically actuated ink jet printhead that overcomes problems associated with some other formation methods, and the formation process that having a more stable operation at changing environmental conditions would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a printhead includes a plurality of electrostatic actuators, wherein each electrostatic actuator includes: a patterned first conductive layer overlying a semiconductor substrate assembly and including a first portion, a patterned second conductive layer having a first portion physically and electrically contacting the first portion of the patterned first conductive layer, wherein the first portion of the patterned second conductive layer is at least part of an actuator electrode, and a first dielectric layer overlying the semiconductor substrate assembly and has a sidewall. Each electrostatic actuator further includes a second dielectric layer overlying the first dielectric layer, wherein the sidewall is laterally recessed under the second dielectric layer to provide a recess, a second portion of the second conductive layer on the second dielectric layer, and an actuator membrane diffusion bonded to the second portion of the second conductive layer.

In another embodiment, a method for forming an electrostatic actuator for a printhead may include forming a patterned first conductive layer over a semiconductor substrate assembly, wherein the patterned first conductive layer includes a first portion, forming a blanket first dielectric layer over the first conductive layer, forming a blanket second dielectric layer over the blanket first conductive layer, and patterning the blanket second dielectric layer and the blanket first dielectric layer to expose the first portion of the patterned first conductive layer. The method may further include isotropically etching the first dielectric layer to laterally etch a sidewall of the first dielectric layer under the second dielectric layer to provide a recess, forming a self-patterned second conductive layer using a directional deposition process, wherein the second conductive layer has a first portion physically and electrically contacting the first portion of the first conductive layer and forming at least a portion of an actuator electrode and a second portion physically contacting the second dielectric layer, wherein the first portion of the second conductive layer is electrically isolated from the second portion of the second conductive layer, and diffusion bonding an actuator membrane to the second portion of the second conductive layer.

In another embodiment, a printer may include a printhead, where the printhead includes a plurality of electrostatic actuators, wherein each electrostatic actuator includes a patterned first conductive layer overlying a semiconductor substrate assembly and including a first portion, a patterned second conductive layer having a first portion physically and electrically contacting the first portion of the patterned first conductive layer, wherein the first portion of the patterned second conductive layer is at least part of an actuator electrode, and a first dielectric layer overlying the semiconductor substrate assembly and having a sidewall. Each electrostatic actuator further includes a second dielectric layer overlying the first dielectric layer, wherein the sidewall is laterally recessed under the second dielectric layer to provide a recess, a second portion of the second conductive layer on the second dielectric layer, and an actuator membrane diffusion bonded to the second portion of the second conductive layer. The printer further includes a housing that encases the printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

An embodiment of the present teachings may result in an electrostatic actuator having an improved physical connection between an actuator membrane and a dielectric gap standoff layer. The process and structure can include a final metal layer deposition which is self-patterned (i.e., patterned in situ), and requires little or no subsequent processing. Using the final metal layer, the membrane may be bonded to the gap standoff layer using a diffusion process to result in a precision gap height and electrical isolation between the membrane and the electrode.

Figure 1:
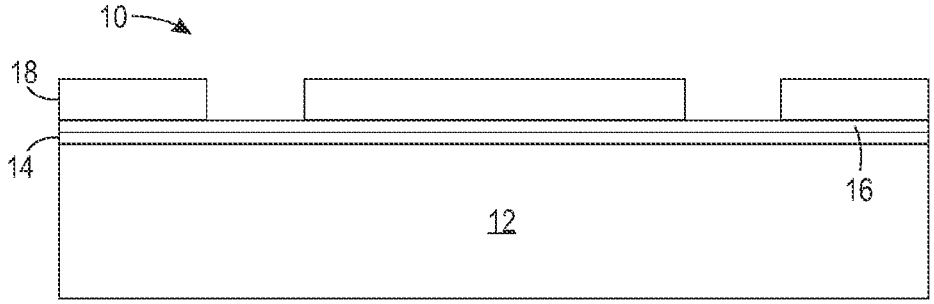
FIGS. 1-6 are cross sections depicting in-process structures in accordance with an embodiment of the present teachings.
Figure 2:
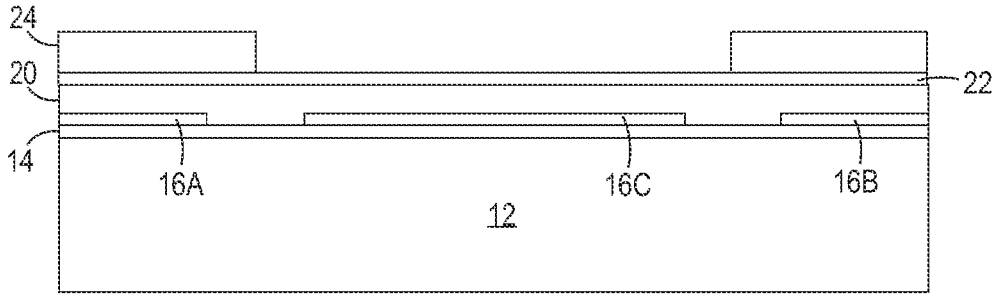

In-process structures which can be formed during an embodiment of the present teachings are depicted in FIGS. 1-6. It will be understood that the structures depicted in the FIGS. may include additional features not depicted for simplicity, while depicted structures may be removed or modified. The in-process electrostatic actuator structure 10 of FIG. 1 includes a semiconductor substrate assembly 12, a blanket dielectric layer 14, a first conductive layer 16 (e.g., a Metal 1 layer), and a patterned first mask layer 18. In the various embodiments herein, the semiconductor substrate assembly 12 may include a silicon wafer or wafer section, and may further include various other layers (not depicted for simplicity) such as various doped regions and one or more layers such as an oxide layer on which the blanket dielectric layer 14 is formed. The blanket dielectric layer 14 may include a nitride layer such as silicon nitride or oxynitride between about 0.01 μm and about 1.0 μm thick. The conductive layer 16 may include an aluminum layer between about 0.1 μm and about 0.6 μm thick. The patterned mask layer 18, which may be photoresist or another mask, exposes first portions of the conductive layer 16 and covers second portions of the conductive layer 16. Subsequently, an etch is performed to remove the exposed first portions of the conductive layer 16 and to stop on the dielectric layer 14, which forms a patterned conductive layer 16 as depicted in FIG. 2. A suitable etch is known in the art. After etching the conductive layer 16, the mask layer 18 is removed, which results in conductive portions 16A, 16B, and 16C. In an embodiment, portion 16C of conductive layer 16 will provide an actuator electrode and portions 16A, 16B will support the dielectric gap standoff layer as described below.

Subsequently, a blanket oxide layer 20 is deposited, a blanket nitride layer 22 is deposited, and a patterned second mask 24 is formed to result in a structure similar to that depicted in FIG. 2. The blanket oxide 20 may be deposited to a thickness of between about 0.1 μm and about 2.0 μm and the blanket nitride layer 22 may be between about 0.01 μm and about 1.0 μm thick. The patterned second mask 24 exposes first portions of the blanket oxide layer 20 and the blanket nitride layer 22. It will be understood that other dielectric materials may be suitable, wherein dielectric layers 14, 20, and 22 are selected so that dielectric 20 may be etched selective to dielectrics 14 and 22 (i.e., layer 20 may be etched at a faster rate than layers 14 and 22). The patterned second mask 24 will define a width of the actuator air chamber, and is positioned to expose portion 16C of conductive layer 16, which will form a portion of the actuator electrode.

Figure 3:
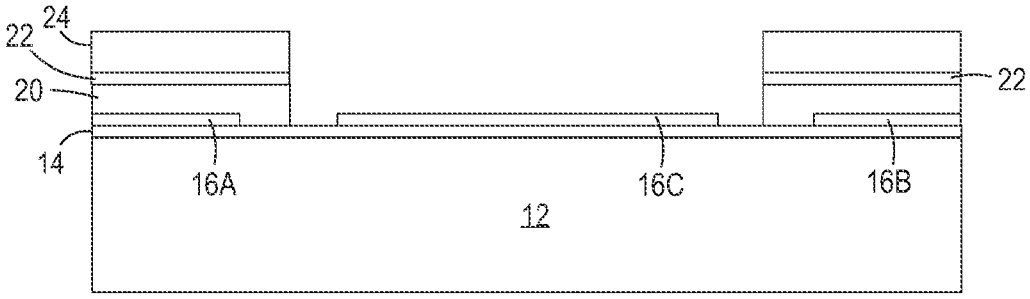

Next, as depicted in FIG. 3, the blanket nitride layer 22 and blanket oxide layer 20 are etched using, for example, a generally vertical anisotropic etch to expose the conductive layer 16 and the nitride layer 14 as depicted. In an embodiment, a first etch chemistry may be used to remove the exposed portions of the nitride layer 22 and stop on the blanket oxide layer 20, then a second etch chemistry may be used to remove the exposed portions of the blanket oxide layer 20 and stop on the conductive layer 16 and nitride layer 14.

Figure 4:
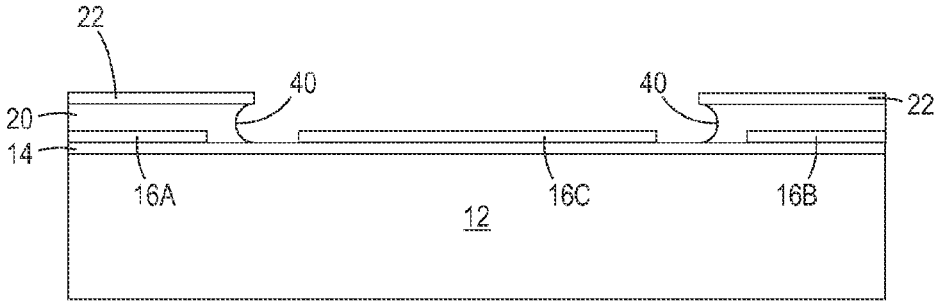

Subsequently, the second mask layer 24 is removed and an isotropic etch of oxide layer 20 is performed to result in the FIG. 4 structure. An etch chemistry is used that removes exposed portions of oxide layer 20 at a faster rate than it removes exposed nitride layers 14, 22 and conductive layer 16. In an embodiment, an etch chemistry may include a buffered oxide (i.e., BOE) etch, dilute hydrofluoric (HF) acid, vapor HF, and tetrafluoromethane ($CF_4$) gas blends. The isotropic etch of the oxide layer 20 undercuts the nitride layer 14 and recesses sidewalls 40 of the oxide layer 20 laterally (i.e., horizontally as depicted in FIG. 4) under the nitride layer 14 and between the nitride layers 14, 22. In an embodiment, the sidewalls 40 of the oxide layer 20 may be recessed between about 0.1 μm and about 1.0 μm under the nitride layer 22 at its furthest extent. While each sidewall of oxide layer 20 depicted in FIG. 5 has a semicircular profile, the sidewall may be vertical, near vertical, or have other profiles which are contemplated depending on the etch process used. Additionally, it will be appreciated that while FIG. 5 depicts first and second sidewalls 40, the sidewalls 40 may partially define a continuous square or rectangular opening, ring, or pocket around portion 16C of layer 16 that exposes portion 16C, and thus appear as two separate sidewalls in the depicted cross section.

Figure 5:
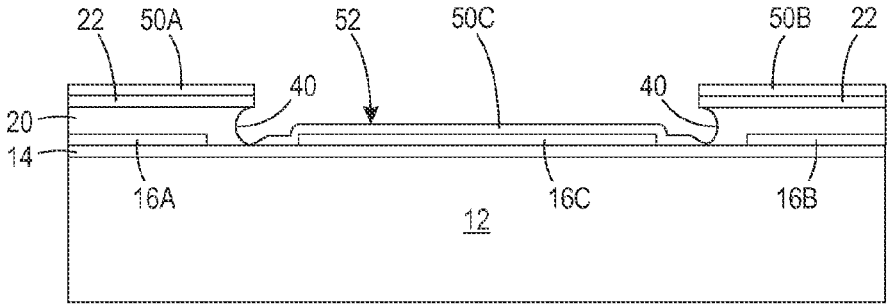

Next, a second conductive layer 50 (e.g., a Metal 2 layer) is formed as depicted in FIG. 5. The second conductive layer 50 may be formed, for example, using a directional deposition process that has poor step coverage over non-horizontal surfaces, particularly over vertical or near-vertical surfaces, for example a sputtering process, an evaporation process such as thermal or e-beam evaporation, a vapor deposition process such as chemical vapor deposition (CVD), physical vapor deposition (PVD), plasma-enhanced CVD (PECVD), etc. Deposition parameters for each of these processes, which employ the use of a deposition having poor step coverage, may be determined by one of ordinary skill in the art from the information herein. In an embodiment, a sputtering process of a metal such as silver may be used to form the second conductive layer 50. Because the sidewalls 40 of oxide layer 20 are laterally recessed between nitride layers 14, 22, the directional deposition of second conductive layer 50 results in a material void so that portions 50A, 50B of layer 50 are electrically isolated from portion 50C. This process thus forms a self-patterned (i.e., patterned in situ) layer 50. For purposes of this disclosure, a self-patterned layer is an electrically conductive layer formed using a blanket deposition process that requires no separate mask or etch of the conductive layer to provide two or more portions that are electrically isolated from each other. In this embodiment, layer 50 is formed using a blanket deposition process where portion 50C is electrically isolated from portions 50A and 50B without requiring a separate masked etch of layer 50 to provide the portions that are electrically isolated from each other. In this process, electrical isolation between portions 50A, 50B from portion 50C results as long as layer 50 is formed with a target thickness that is less than a target thickness of the oxide layer 20. Generally, oxide layer 20 will have a much higher target thickness than conductive layer 50, for example between about 15 and about 25 times the target thickness. In an embodiment, layer 50 may have a target thickness of about 0.05 μm while oxide layer 20 has a target thickness of about 1.0 μm. It will be appreciated that portions 50A and 50B may form a ring around portion 50C and thus may be electrically coupled together and form a single, continuous structure.

Portion 50C of conductive layer 50 physically and electrically contacts portion 16C of conductive layer 16 as depicted. Portion 16C of conductive layer 16 and portion 50C of conductive layer 50 thus form the completed actuator electrode 52. As depicted in FIG. 5, portion 50C of conductive layer 50 is formed directly on, and in electrical communication with, portion 16C of layer 16. Further, portion 50C is wider than portion 16C, thus effectively increasing the width of the completed actuator electrode 52. As depicted in the cross section of FIG. 5, actuator electrode 52 covers all exposed portions of nitride layer 14, and thus maximizes the width of the actuator electrode 52. The width of portion 50C of actuator 52 is therefore self-patterned. A major (i.e., outside) width of the actuator electrode 52 is thus provided by a self-patterned layer 50C that forms a portion of the actuator electrode 52. The outside edges of the actuator electrode 52 are thus aligned to the actuator air chamber without risk of electrical shorting. The outside edges of the actuator electrode 52 provided by portion 50C may be formed directly under the nitride layer 22 within the recess provided by the etched oxide sidewalls 40.

Figure 6:
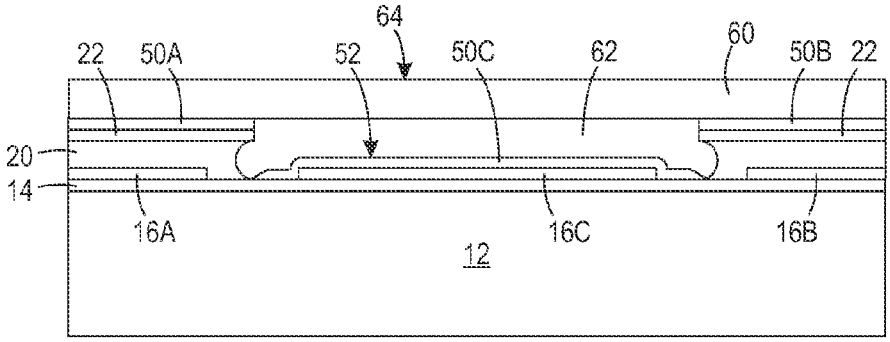

Next, portions 50A and 50B of layer 50 are used to physically attach an actuator membrane 60 as depicted in FIG. 6. In an embodiment, the membrane 60 may be an iron-nickel alloy such as Invar (64FeNi), a silicon layer, or another suitable material, having a thickness of between about 2.0 μm and about 40 μm, or between about 10 μm and about 20 μm. The membrane 60 may have a thin coating of the same or a similar metal used for layer 50. In an embodiment, the membrane 60 may be placed, under pressure (for example in a press), in physical contact with portions 50A, 50B of layer 50, and then heated to atomically comingle layer 50A, 50B with membrane 60. For example, the structure of FIG. 6 may be placed within a press and, under a pressure of between about 50 psi and about 25,000 psi, or between about 75 psi and about 1,000 psi, or between about 100 psi and about 500 psi, heated to a temperature of between about 150° C. and about 350° C. The structure may then cooled to bond the membrane 60 to the semiconductor substrate assembly 12 through the various intervening layers using conductive layer 50A, 50B. This diffusion bond process joins layers 50A, 50B with membrane 60 without filler metals or other separate adhesives using only heat and pressure. The bonding temperature is below the melting points of both layer 50 and membrane 60. Without being bound by theory, the atoms at the interface of layer 50 and membrane 60 migrate across the interface, grain boundaries shift, and micro gaps are reduced. The final boundary between portions 50A, 50B of layer 50 and membrane 60 is obscured by this mingling. Attachment of the actuator membrane 60 completes the formation of an actuator air chamber 62 for each actuator 64 which is part of an actuator array that includes a plurality of actuators.

It will be appreciated that the addition of layer 50 does not affect the gap height between the actuator electrode 52 and the actuator membrane 60. For example, portions 50A, 50B have the same thickness as portion 50C, and thus the net distance between actuator electrode 52, which includes portion 50C, and the bottom of the actuator membrane 60 is not changed by an amount that requires compensation in most uses. If any compensation is required, the target deposition thickness of one or more layers of FIG. 6 may be adjusted.

In another embodiment as depicted in FIGS. 7-13, a process including two conductive layers may be used to increase the trace routing density. A first conductive layer, such as an aluminum layer used as Metal 1, may be used to form a plurality of traces and a second conductive layer, such as a silver layer used as Metal 2, may be used to form the actuator electrode and a diffusion bonding material. It will be understood that the structures depicted in the FIGS. may include additional features not depicted for simplicity, while depicted structures may be removed or modified.

Figure 7:
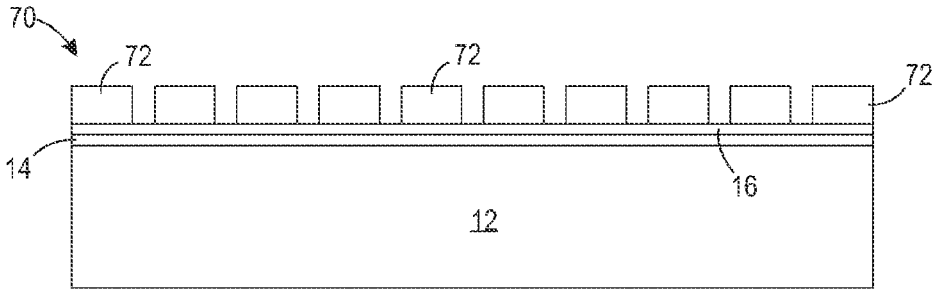
FIGS. 7-13 are cross sections depicting in-process structures in accordance with another embodiment of the present teachings.
Figure 8:
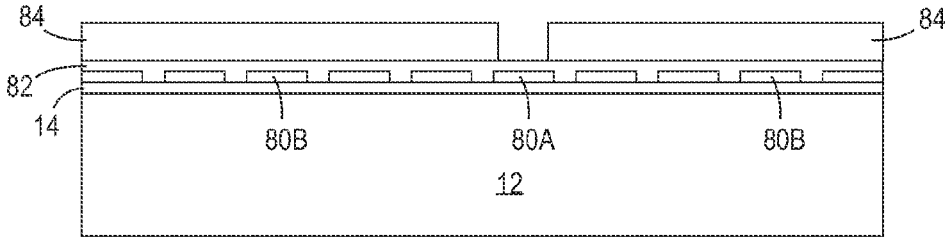

The in-process electrostatic actuator structure 70 of FIG. 7 includes a semiconductor substrate assembly 12, a blanket dielectric layer 14, a first conductive layer 16 (e.g., a Metal 1 layer), and a patterned first mask layer 72. In an embodiment, the semiconductor substrate assembly 12 may include a silicon wafer or wafer section. The blanket dielectric layer 14 may include a nitride layer such as silicon nitride or oxynitride, an oxide, or another dielectric, for example between about 0.01 μm and about 1.0 μm thick. The conductive layer 16 may include an aluminum layer between about 0.1 μm and about 1.0 μm thick. The patterned mask layer 72, which may be photoresist or another mask, exposes first portions of the conductive layer 16 and covers second portions of the conductive layer 16. Subsequently, an etch is performed to remove the exposed first portions of the conductive layer 16 and to stop on the dielectric layer 14, which forms a plurality of traces 80 from layer 16 as depicted in FIG. 8. In the FIGS., first portion "80A" of layer 80 designates the trace for the depicted electrostatic actuator while second portions "80B" of layer 80 designates traces routed to the non-depicted electrostatic actuators at other locations within the printhead. A suitable etch for etching a conductive layer 16 selective to a dielectric layer 14 is known in the art. After etching the conductive layer 16, the mask layer 72 is removed.

Next, a blanket planar second dielectric layer 82 and a second mask 84 are formed as depicted in FIG. 8. The second dielectric layer 82 may a nitride such as a silicon nitride or an oxynitride. The mask layer 84 may expose first portions of the traces 80 (for example, trace "80A" at the depicted location, and traces 80B at other, non-depicted actuator electrode locations) and cover second portions of the traces 80 (for example, trace "80A" at other, non-depicted locations). In general, each trace 80 will be exposed by the second mask layer 84 at only one actuator electrode location such that each future actuator electrode may be individually addressed using one of the traces 80. It will be appreciated that the second mask layer 84 may also expose each trace 80 at other non-depicted locations to provide one or more contacts to each trace 80 through openings within the second dielectric layer 82. After forming a structure similar to that depicted in FIG. 8, the second dielectric layer 82 is etched using the second mask 84 as a pattern to expose each trace 80 at one or more locations. Subsequently, the second mask 84 is removed.

Figure 9:
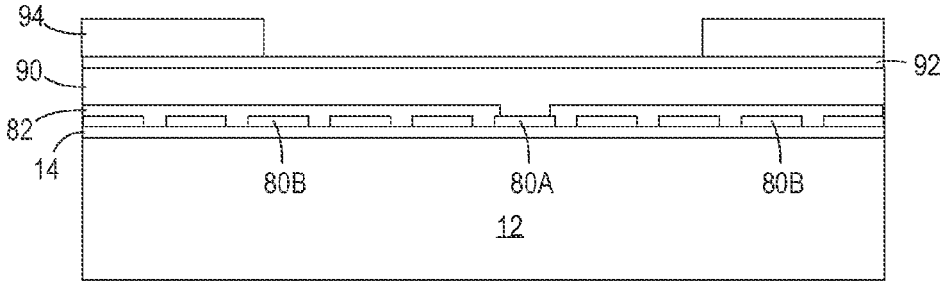

Subsequently, a blanket oxide layer 90 is deposited, a blanket nitride layer 92 is deposited, and a patterned third mask 94 is formed to result in a structure similar to that depicted in FIG. 9. The blanket oxide 90 may be deposited to a thickness of between about 0.1 μm and about 2.0 μm and the blanket nitride layer 92 may be between about 0.01 μm and about 1.0 μm thick. The patterned third mask 94 exposes first portions of the blanket oxide layer 90 and the blanket nitride layer 92. It will be understood that other dielectric materials may be suitable, wherein dielectric layers 82, 90, and 92 are selected so that dielectric 90 may be etched selective to dielectrics 82 and 92 (i.e., layer 90 may be etched at a faster rate than layers 82 and 92). The patterned third mask 94 will define a width of the actuator air chamber as described below.

Figure 10:
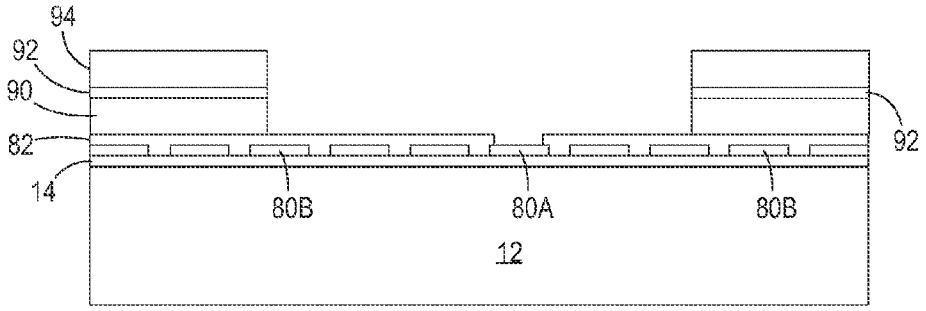

Next, as depicted in FIG. 10, the blanket nitride layer 92 and blanket oxide layer 90 are etched to expose the traces 80 and the nitride layer 82 as depicted. In an embodiment, a first etch chemistry may be used to remove the exposed portions of the nitride layer 92 and stop on the blanket oxide layer 90, then a second etch chemistry may be used to remove the exposed portions of the blanket oxide layer 90 and stop on the traces 80 and nitride layer 82.

Figure 11:
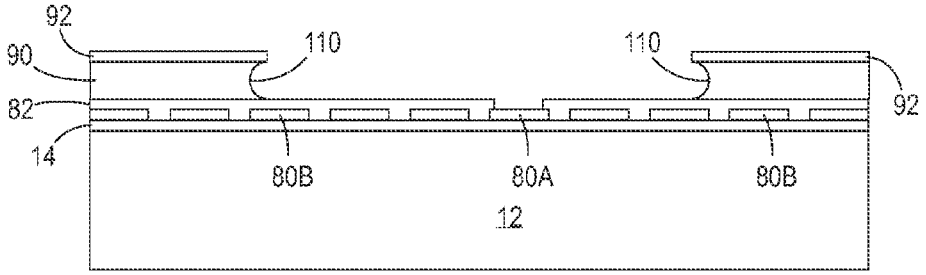

Subsequently, the third mask layer 94 is removed and an isotropic etch of oxide layer 90 is performed to result in the FIG. 11 structure. An etch chemistry is used that removes exposed portions of oxide layer 90 at a faster rate than it removes exposed nitride layers 82, 92 and traces 80. In an embodiment, an etch chemistry may include a buffered oxide etch (BOE), dilute HF, vapor HF, and $CF_4$ gas blends, for example. The isotropic etch of the oxide layer 90 undercuts the nitride 92 and recesses sidewalls 110 of the oxide layer 90 laterally (i.e., horizontally as depicted in FIG. 11) under the nitride layer 92 and between the nitride layers 92, 82. Further, in contrast to the embodiment of FIGS. 1-6, the dielectric layer 14 is not exposed to this isotropic undercut etch. In an embodiment, the sidewalls of the oxide layer 90 may be recessed between about 0.01 μm and about 2.0 μm, or between about 0.5 μm and about 1.0 μm, under the nitride layer 92 at its furthest extent. While each sidewall 110 of oxide layer 90 depicted in FIG. 11 has a semicircular profile, other profiles are contemplated depending on the etched used.

Figure 12:
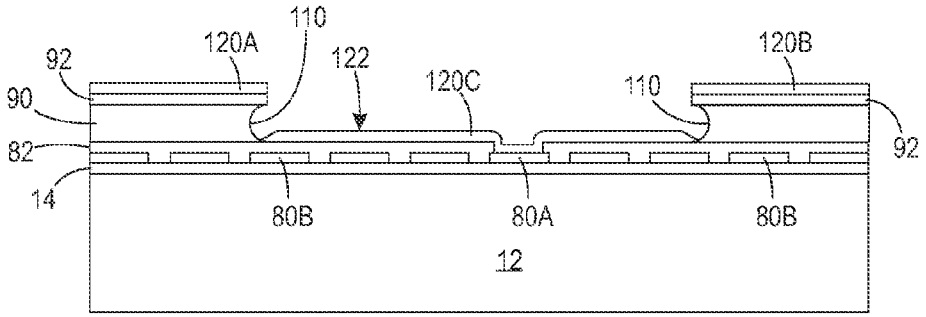

Next, a second conductive layer 120 (e.g., a Metal 2 layer) is formed as depicted in FIG. 12. The second conductive layer 120 may be formed, for example, using a directional deposition process, such as a sputtering process. In an embodiment, the second conductive layer 120 may be sputtered silver. Because the sidewalls 120 of oxide layer 90 are laterally recessed between nitride layers 82, 92, the directional deposition results in a material void so that portions 120A, 120B of layer 120 are electrically isolated from portion 120C. This process thus forms a self-patterned (i.e., patterned in situ) layer 120. In this embodiment, layer 120 is formed using a blanket deposition process, such as one of the techniques disclosed above, where portion 120C is electrically isolated from portions 120A and 120B without requiring a separate masked etch of layer 50 to provide the portions that are electrically isolated from each other. In this process, as with the process described with reference to FIGS. 1-6, electrical isolation between portions 120A, 120B and portion 120C results as long as layer 120 is formed with a target thickness that is less than a target thickness of the oxide layer 90.

Portion 120C of conductive layer 120 physically and electrically contacts exposed trace 80A as depicted, thereby completing an electrical connection between trace 80A and actuator electrode 122 through the via in the dielectric 82. Similar electrical connections between the other traces 80B and other actuator electrodes 122 (not depicted for simplicity) are completed simultaneously. Portion 120C of conductive layer 120 thus forms the completed actuator electrode that may be individually addressed through the trace 80 to which it is electrically coupled. As depicted in FIG. 12, portion 120C of conductive layer 120 is formed directly on, and in electrical communication with, exposed trace 80A. As depicted in the cross section of FIG. 12, actuator electrode 120C covers all exposed portions of nitride layer 82, and thus maximizes the width of the actuator electrode compared to some prior electrodes. The width of portion 120C that forms the actuator is therefore self-patterned. A major (i.e., outside) width of the actuator electrode 120C is thus provided by a self-patterned layer. The outside edges of the actuator electrode 122 are thus aligned to the actuator air chamber without risk of electrical shorting. The outside edges of the actuator electrode 122 provided by portion 120C may be formed directly under the nitride layer 92 within the recess provided by the etched oxide sidewalls 110.

Figure 13:
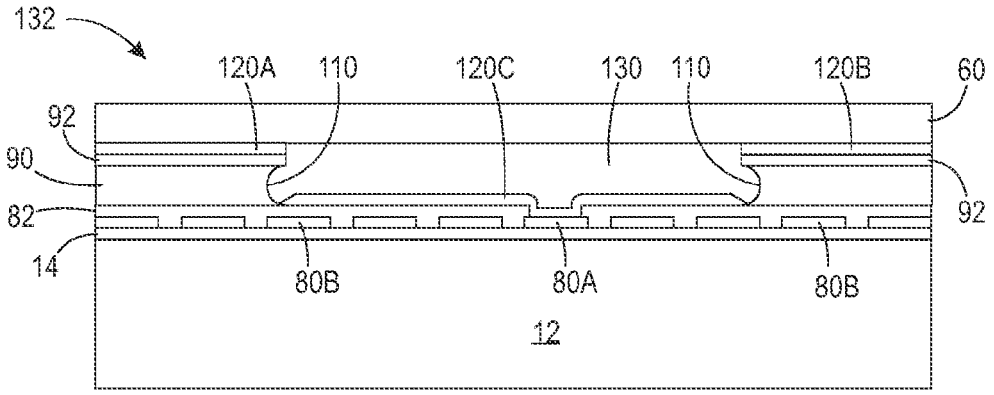

Next, portions 120A and 120B of layer 120 are used to physically attach an actuator membrane 60 as depicted in FIG. 13 and described with reference to FIG. 6. This provides an electrostatic actuator air chamber 130 and a completed actuator 132 as part of an electrostatic actuator array including a plurality of electrostatic actuators.

Thus the structure of FIG. 13 includes a plurality of traces 80 that are routed underneath the actuator electrodes 120C. In this embodiment, a plurality of traces 80B (i.e., trace 80A and five traces 80B in this embodiment) are directly interposed between actuator electrode 120C and the semiconductor substrate assembly 12 in a direction perpendicular to the upper surface of the substrate 12. Each trace 80 may be electrically coupled with a different actuator electrode 120C such that each actuator electrode 120 of the electrostatic actuator array may be individually addressed to provide a drop-on-demand printhead. Spacing between each trace 80 and the composition and thickness of the nitride layer 82 may be selected to reduce crosstalk between adjacent traces 80. A printhead formed as described herein provides traces 80 that are routed between the actuator electrodes 120C and the substrate 12.

Figure 14:
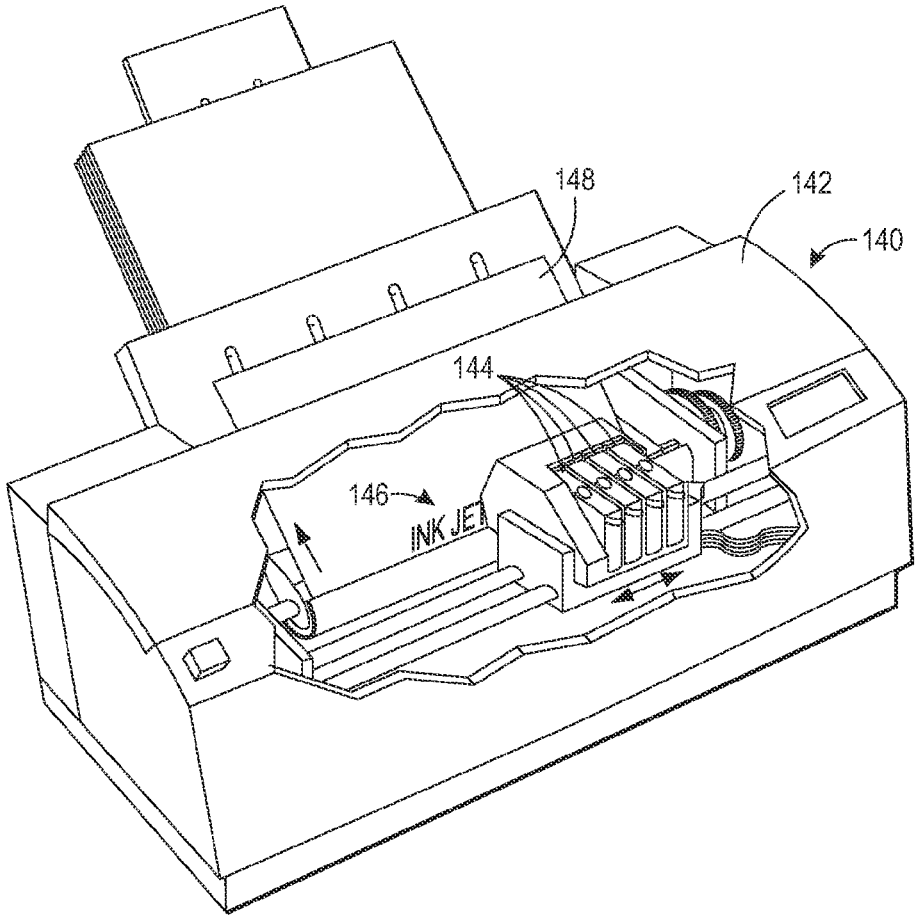
FIG. 14 is a perspective depiction of a printer including a printhead according to an embodiment of the present teachings.

FIG. 14 depicts a printer 140 including a printer housing 142 into which at least one printhead 144 including an embodiment of the present teachings has been installed. The housing 142 may encase the printhead 144. During operation, ink 146 is ejected from one or more printheads 144. The printhead 144 is operated in accordance with digital instructions to create a desired image on a print medium 148 such as a paper sheet, plastic, etc. The printhead 144 may move back and forth relative to the print medium 148 in a scanning motion to generate the printed image swath by swath. Alternately, the printhead 144 may be held fixed and the print medium 148 moved relative to it, creating an image as wide as the printhead 144 in a single pass. The printhead 144 can be narrower than, or as wide as, the print medium 148. In another embodiment, the printhead 144 can print to an intermediate surface such as a rotating drum or belt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead comprising a plurality of electrostatic actuators, wherein each electrostatic actuator comprises:

a patterned first conductive layer overlying a semiconductor substrate assembly and comprising a first portion;

a patterned second conductive layer having a first portion physically and electrically contacting the first portion of the patterned first conductive layer, wherein the first portion of the patterned second conductive layer is at least part of an actuator electrode;

a first dielectric layer overlying the semiconductor substrate assembly and comprising a sidewall;

a second dielectric layer overlying the first dielectric layer, wherein the sidewall is laterally recessed under the second dielectric layer to provide a recess;

a second portion of the second conductive layer on the second dielectric layer; and an actuator membrane diffusion bonded to the second portion of the second conductive layer.

2. The printhead of claim 1, wherein the first portion of the second conductive layer comprises an edge within the recess.

3. The printhead of claim 1, wherein the second conductive layer is a self-patterned layer.

4. The printhead of claim 1, further comprising a third dielectric layer underlying the first portion of the patterned first conductive layer and the first portion of the second conductive layer, wherein the sidewall is recessed between the second dielectric layer and the third dielectric layer.

5. The printhead of claim 1, further comprising a third dielectric layer interposed between the first conductive layer and the first portion of the second conductive layer, wherein the sidewall is recessed between the second dielectric layer and the third dielectric layer.

6. The printhead of claim 1, wherein:

the patterned first conductive layer further comprises a plurality of second portions that provide a plurality traces for the plurality of electrostatic actuators; and the plurality of traces are directly interposed between the first portion of the second conductive layer and the semiconductor substrate assembly.

7. The printhead of claim 1, wherein:

the first portion of the patterned first conductive layer comprises a first width; and the first portion of the patterned second conductive layer comprises a second width that is wider than the first width.

8. A printer, comprising:

a printhead comprising a plurality of electrostatic actuators, wherein each electrostatic actuator comprises:

a patterned first conductive layer overlying a semiconductor substrate assembly and comprising a first portion;

a patterned second conductive layer having a first portion physically and electrically contacting the first portion of the patterned first conductive layer, wherein the first portion of the patterned second conductive layer is at least part of an actuator electrode;

a first dielectric layer overlying the semiconductor substrate assembly and comprising a sidewall;

a second dielectric layer overlying the first dielectric layer, wherein the sidewall is laterally recessed under the second dielectric layer to provide a recess;

a second portion of the second conductive layer on the second dielectric layer; and an actuator membrane diffusion bonded to the second portion of the second conductive layer; and a housing that encases the printhead.

9. The printer of claim 8, wherein the first portion of the second conductive layer comprises an edge within the recess.

10. The printer of claim 8, wherein the second conductive layer is a self-patterned layer.

11. The printer of claim 8, wherein the printhead further comprises a third dielectric layer underlying the first portion of the patterned first conductive layer and the first portion of the second conductive layer, wherein the sidewall is recessed between the second dielectric layer and the third dielectric layer.

12. The printer of claim 8, wherein the printhead further comprises a third dielectric layer interposed between the first conductive layer and the first portion of the second conductive layer, wherein the sidewall is recessed between the second dielectric layer and the third dielectric layer.

13. The printer of claim 8, wherein:

the patterned first conductive layer further comprises a plurality of second portions that provide a plurality traces for the plurality of electrostatic actuators; and the plurality of traces are directly interposed between the first portion of the second conductive layer and the semiconductor substrate assembly.

14. The printer of claim 8, wherein:

the first portion of the patterned first conductive layer comprises a first width; and the first portion of the patterned second conductive layer comprises a second width that is wider than the first width.

* * * * *